United States Patent [19]

Ikeda

[11] Patent Number: 4,711,104

[45] Date of Patent: Dec. 8, 1987

[54] WASHING MACHINE

[75] Inventor: Yoshio Ikeda, Aichi, Japan

[73] Assignee: Kabushiki Kaisha Toshiba, Kawasaki, Japan

[21] Appl. No.: 850,078

[22] Filed: Apr. 9, 1986

Related U.S. Application Data

[63] Continuation of Ser. No. 618,349, Jun. 7, 1984, abandoned.

[30] Foreign Application Priority Data

Jun. 9, 1983 [JP] Japan ..... 58-104504
Aug. 9, 1983 [JP] Japan ..... 58-145551
Aug. 22, 1983 [JP] Japan ..... 58-128421

[51] Int. Cl.[4] ..... D06F 23/04
[52] U.S. Cl. ..... 68/23 R; 68/174
[58] Field of Search ..... 68/23 R, 38, 53, 89, 68/136, 148, 154, 171, 172, 173, 174; 210/364, 365

[56] References Cited

U.S. PATENT DOCUMENTS 1,211,129 1/1917 Franklin ..... 68/89
1,898,221 2/1933 Snyder ..... 68/174
2,575,691 11/1951 Smith ..... 68/174 X
2,652,710 9/1953 DeRemer ..... 68/23.2
2,986,916 6/1961 Bochan ..... 68/23 R X
4,202,187 5/1980 Hukuzawa et al. ..... 68/23 R X

FOREIGN PATENT DOCUMENTS 200603 1/1956 Australia .
13469 5/1961 Japan .
25878 2/1980 Japan .
2141742 1/1985 United Kingdom .

*Primary Examiner*—Philip R. Coe
*Attorney, Agent, or Firm*—Cushman, Darby & Cushman

[57] ABSTRACT

A washing machine includes a washing tub whose peripheral wall is constituted by an upper peripheral wall section and a lower peripheral wall section which is located below the upper peripheral wall section and which is driven to rotate clockwise and counterclockwise. The washing tub receives water and laundry therein. In the case of a small load of laundry, the laundry is caused to flow, and to be washed due mainly to the flow or water caused by the rotation of the lower peripheral wall section. In the case of a large amount of the load of laundry, the laundry can be due to the synergetic action of the frictional forces. In such a washing machine, the inner surface of the lower peripheral wall section is made gradually larger in diameter from its lower portion to its upper portion.

18 Claims, 14 Drawing Figures

WASHING MACHINE

This is a continuation of application Ser. No. 618,349, filed June 7, 1984 which was abandoned upon the filing hereof.

BACKGROUND OF THE INVENTION

The present invention relates to a washing machine comprising a washing tub including an upper peripheral wall section which is stationary in a washing mode and a lower peripheral wall section which is driven to rotate clockwise and counterclockwise in the washing mode, and more particularly, relates to a washing machine arranged such that a load or loads of laundry are received in the washing tub together with water, whereby, in the case of a small amount of laundry, the laundry is caused to cycle, and is washed, due mainly to the water flow caused by the rotation of the lower peripheral wall section, and, in the case of a large amount of laundry, the laundry is washed due to the friction of the laundry against the upper peripheral wall section, as well as due to the laundry cycle caused by the frictional force produced by its contact with the lower peripheral wall section.

In a prior art washing machine of a pulsator type wherein the water flow is caused by a pulsator, the laundry is washed as it follows the cycling water. In this type of washing machine, therefore, the washing tub is required to have a capacity large enough to handle a specified size of load. This means that the amount of the load of laundry capable of being washed at one time is small. Further, where the amount of laundry to be cleaned is too small, the flow of water becomes extremely intense causing the laundry to be washed excessively. On the other hand, where the amount of laundry to be washed is too large, the speed of the flow of the water decreases correspondingly, whereby the washing effect tends to become diminished. Further, in this type of washing machine, the laundry and the pulsator come into contact with each other only accidently and partly. For this reason, it can not be expected to attain a washing-by-rubbing effect, or a washing-by-friction effect for the entire load. Stated differently, it is pointed out with respect to this type of washing machine that a load or loads of laundry are likely to be washed unevenly, and to be damaged.

Meanwhile, a washing machine has been recently proposed in which no pulsator is provided and in which the washing tub as a whole is intermittently rotated in a state wherein water and the laundry are received therein, thereby obtaining a washing effect due to the difference in flow speed between the water and the laundry. This type of washing machine has a merit in that no damage is caused to the laundry. However, it has a demerit as well in that the washing effect is small because the motion of the laundry becomes simplified due to the small difference in flow speed between the water and the laundry.

SUMMARY OF THE INVENTION

The present invention has been achieved in view of the above-mentioned circumstances and is intended to provide a washing machine which makes it possible to not only produce a greater and more uniform washing effect than in the prior art without using a pulsator or without rotating the washing tub as a whole, but also to prevent the laundry from being damaged, which makes it possible to wash a larger amount of laundry at one time than in the prior art and, in addition, which widens the range in amount of the laundry within which a moderate washing effect can be maintained.

To attain the above object, according to one aspect of the present invention, there is provided a washing machine having a washing tub whose peripheral wall is constituted by an upper peripheral wall section and a lower peripheral wall section which is located below the upper peripheral wall section and which is driven to rotate clockwise and counterclockwise, said washing tub receiving water and laundry therein, wherein, in the case of a small load of laundry, the laundry is caused to flow, and to be washed, mainly due to the flow of water caused by the rotation of the lower peripheral wall section, and, in the case of a large amount of the load, the laundry can be washed due to the synergistic action of the two frictional forces: one of which is a frictional force produced by the laundry's contact with the lower peripheral wall section which causes the laundry to cycle; and the other of which is a frictional force produced by the friction between the laundry and the upper peripheral wall section, said washing machine being improved so that at least the inner surface of the lower peripheral wall section is made gradually larger in diameter from its lower portion to its upper portion.

By constructing the present invention as one aspect of the above, it is possible to extend to the entire load of laundry both the washing-by-rubbing effect, which is produced by the friction between the laundry and the upper peripheral wall section along with the lower peripheral wall section, and the washing-by-friction effect between the laundry itself, as well as washing-by-massage effect which is produced as a result of the laundry receiving forces acting in different directions from both the upper peripheral wall section and lower peripheral wall section and being thereby massaged.

According to another aspect of the present invention, first projections for rubbing the laundry are provided on the inner peripheral side surface of the lower peripheral wall section while, on the other hand, second projections having a height greater than that of the first projections which are used for producing a flow of water are provided on the inner bottom surface of the lower peripheral wall section.

By constructing the present invention as another aspect of the above, it is possible to increase the friction between the laundry, and the first and second projections and to generate a water stream produced by the second projections. That is to say, a greater washing-by-water-flow effect can be obtained by such a construction even when the amount of laundry is small.

According to still another aspect of the present invention, a third projection protruding upwards is formed at the center of the bottom section of the lower movable peripheral wall section and, a washing shaft for driving the lower movable peripheral wall section to rotate in the clockwise and counterclockwise direction is fitted into and secured in that lower third projection. By constructing the present invention as still another aspect of the above, upper portions and lower portions of the load more frequently change positions with each other, thereby enhancing the washing effect.

DETAILED DESCRIPTION OF THE PREFERRED EMBODIMENT

One embodiment of a washing machine with a dehydrating function according to the present invention, will now be described with reference to the appended drawings.

Figure 1:
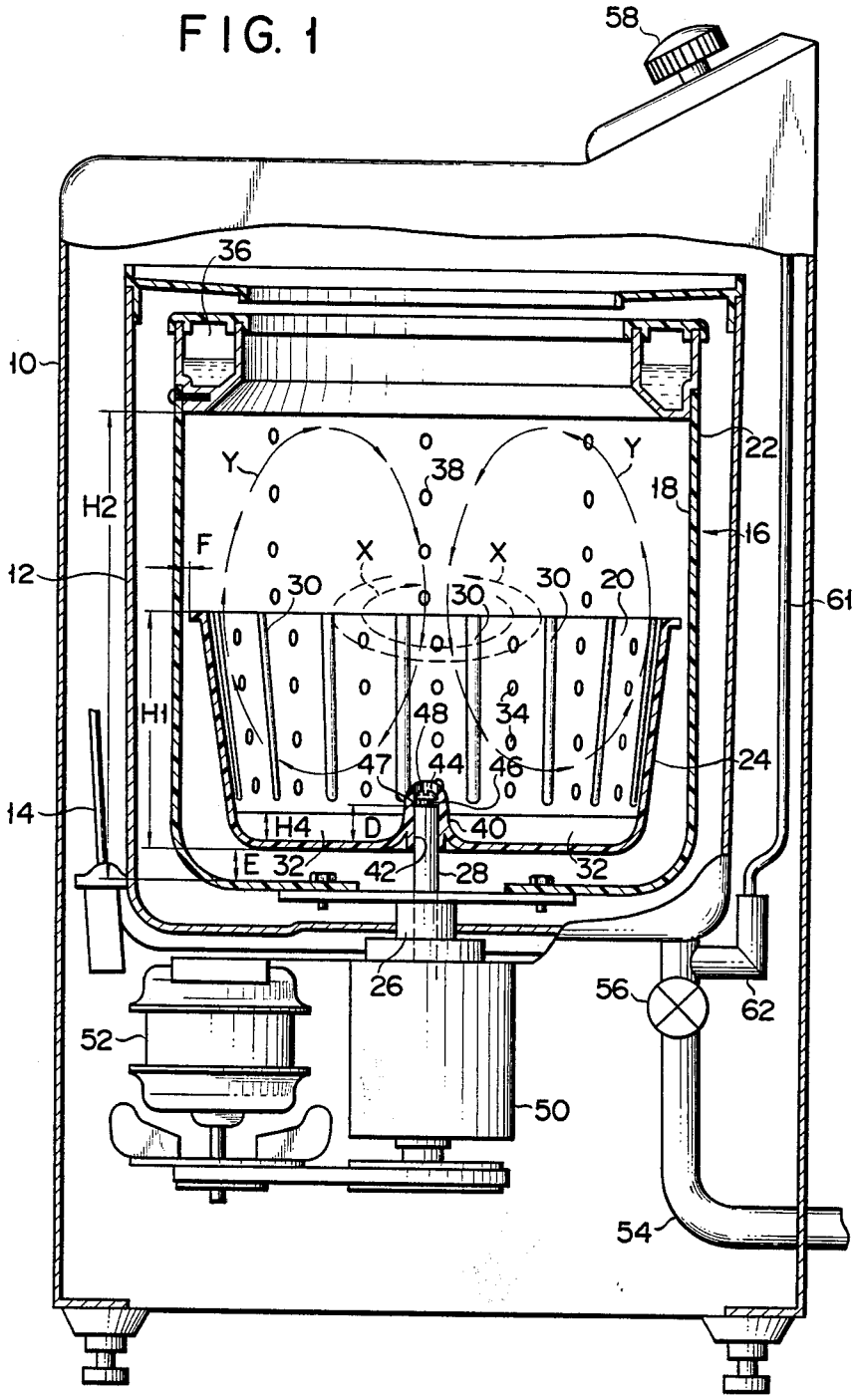
FIG. 1 is a vertically sectional view showing a washing machine according to one embodiment of the present invention.

In FIG. 1, reference numeral 10 denotes an outer casing of the washing machine having a dehydrating function. Within the casing 10, a water-receiving tub 12 is elastically supported through a suspension rod mechanism 14 so that it may be swingable with respect to the outer casing 10. Within the water-receiving tub 12, a washing tub 16 is rotatably received, the peripheral wall of which is constituted by an upper peripheral wall section 18 and a lower peripheral wall section 20 located beneath the upper peripheral wall section 18. Stated differently, the washing tub 16 is comprised of a tub 22 which rotates only during the dehydrating operation, not during the washing operation, and a shallow-vessel like stirring member 24 which is received in the substantially lower half of the tub 22 and which rotates together therewith the tub 22 at the time of the dehydrating operation and is driven, during the washing operation, to rotate in the clockwise and counterclockwise directions. The upper peripheral wall section 18 is constituted by a substantial upper half of the tub 22 while, on the other hand, the lower peripheral wall section 20 is constituted by a peripheral wall of the stirring member 24.

Hereinafter, the washing tub 16 will be described in detail. The tub 22 is rotatably disposed within the water-receiving tub 12. A hollow dehydrating shaft 26 is connected to the central part of the bottom wall of the tub 22. The stirring member 24 is disposed in such a manner as to fit against the inner peripheral-wall surface of the tub 22 and yet be coaxial therewith. The central part of the bottom wall of the stirring member 24 is connected to a washing shaft 28. This washing shaft 28 is provided in such a manner that it extends through the hollow dehydrating shaft 26. The upper end of the washing shaft 28 is allowed to protrude upwards from the inside surface of the bottom of the tub 22 and is attached to the undersurface of the stirring member 24.

Figure 2:
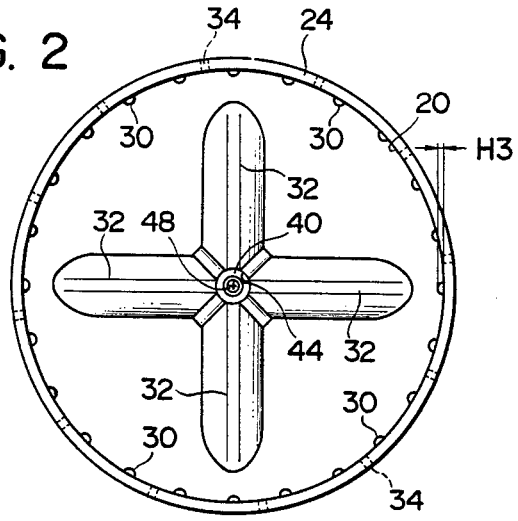
FIG. 2 is a plan view showing a stirring member.

The height H1 of the lower peripheral wall section 20 of the vessel-shaped stirring member 24 is set at a value equal to substantially one-half of the height H2 of the tub 22 ($H1 \approx H2/2$). The inner and outer side surfaces of the stirring member 24 are tapered such that they become gradually larger in diameter from the lower portion toward the upper portion. On the inner sides of the stirring member 24, a plurality of first projections 30 is vertically extended substantially over the entire region, thereby forming linear projections each having a height H3 (shown in FIG. 2). Further, on the bottom of the inside of the stirring member 24, a plurality of second projections 32 each having a height H4 greater than the height H3 of the first projections 30 (see FIG. 2) is radially extended from the center to the periphery, thereby forming linear projections having a height H4. Further, a large number of dehydrating apertures 34 are formed to cover substantially the entire region of the peripheral side surface of the vessel-shaped stirring member 24. In contrast, the tub 22 has the upper peripheral wall section 18 made substantially upright, and is made integral. In this embodiment, the washing tub 16 concurrently serves as a dehydrating tub as well. For this reason, a balancer 36 is attached onto an upper end portion of the tub 22. Further, other dehydrating apertures 38 are formed in the upper peripheral wall section 18 of the tub 22.

A columnar projection 40 (third projection) which protrudes upwards is provided at the center of the inner bottom surface of the stirring member 24. First and second recessed portions 42 and 44 are formed in the lower and upper end surfaces of that projection 40, respectively. Further, a communicating bore 46 for communicating the first recessed portion 42 with the second recessed portion 44 is formed in a partitioning wall portion 47 forming the respective bottom surfaces of the first and second recessed portions 42 and 44. The upper end portion of the washing shaft 28 is fitted into the first recessed portion 42. This washing shaft 28 is secured to the stirring member 24 by means of a screw 48 received into the second recessed portion 44 and inserted through the communicating bore 46. The washing shaft 28 and dehydrating shaft 26 are connected to a washing machine motor 52 as a driving source, through a power control mechanism 50. This power control mechanism 50 transmits, during the washing operation, the rotational force of the washing machine motor 52 to the washing shaft 28 in a manner which reduces the speed of the rotation of the motor and, at the same time, which alternately reverses the direction of rotation to transmit and during the dehydrating operation, the rotational force to the dehydrating shaft 26 and, at the same time, to the washing shaft 28, thereby causing the tub 22 to rotate integrally with the vessel-shaped stirring member 24. For this reason, the power control mechanism 50 has built therein a speed reduction mechanism, clutch mechanism, brake mechanism, etc.

A drainage hose 54 is connected to the bottom portion of the water-receiving tub 12. A drainage valve 56 is mounted midway on the drainage hose 54. This drainage valve 56 controls the water draining from the water-receiving tub 12 and washing tub 16 through the drainage hose 54 to the outside of the machine.

Figure 3:
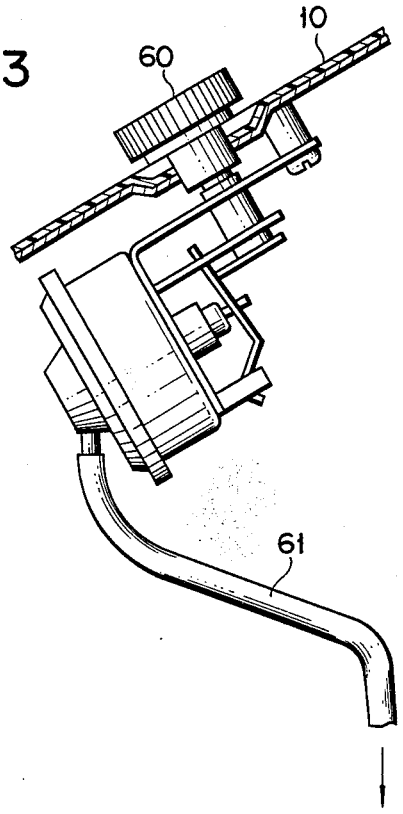
FIG. 3 is a view showing a water-level switch.

A timer device 58 is mounted on the upper portion of the outer casing 10 which controls the various apsects of the washing and dehydrating cycles. Further, as shown in FIG. 3, on the upper portion of the outer casing 10, a water-level switch 60 is mounted in such a manner that it is juxtaposed with the timer device 58. This water-level switch 60 is provided for the purpose of optionally setting the level of the water introduced into the washing tub 16. An air trap 62 is connected to this water level switch 60 through a tube 61, said air trap being mounted on that portion of the drainage hose 54 between the drainage valve 56 and the water-receiving tub 12. The air trap 62 senses the pressure of the water received in the washing tub 16. The water level switch 60 controls, in accordance with the water level sensed by the air trap 62, the timing with which the operation of injecting water into the washing tub 16 is to be completed.

With the above-mentioned construction, when the washing operation is performed, the tub 22 is braked by the brake mechanism (not shown) so as to not rotate while, in contrast, the vessel-shaped stirring member 24 is driven by the motor 52 to rotate in the clockwise and counterclockwise directions. In this way, the peripheral wall portion of the tub 22 exposed above the peripheral wall of the vessel-shaped stirring member 24 functions the same way as the upper peripheral wall section 18 constituting a part of the peripheral wall of the washing tub 16. In the meantime, the peripheral wall of the vessel-shaped stirring member 24 functions the same way as the lower peripheral wall section 20 of the washing tub 16.

The action of the washing machine having the above-mentioned construction will now be described. At the start of washing cycle, as in an ordinary washing machine, the amount of water fed into the washing tub 16 should match the amount of laundry thrown in between the upper edge of the stirring member 24 and the lower edge of the balancer 36. Thus, the washing operation is performed by merely rotating the vessel-shaped stirring member 24 clockwise and counterclockwise so that the tub 22 is stopped by the brake mechanism so as not to rotate. In this embodiment, the number of rotations of the vessel-shaped stirring member 24 is chosen to range from 120 to 180 round per minute and the direction of rotation is reversed in units of two to three rotations, i.e., every third or fourth rotation.

Meanwhile, in the washing operation performed in the above-mentioned manner, the laundry is allowed to contact the peripheral wall 20 of the vessel-shaped stirring member 24 and also the upper half portion of the peripheral wall of the tub 22. For this reason, by being brought into frictional contact with the stirring member 24, the lower portion of the laundry is imparted with a rotational force acting in a substantially horizontal plane as indicated by the arrow X. On the other hand, the upper portion of the laundry is imparted with a binding force by being brought into frictional contact with the tub 22. Because of the frictional forces acting in different directions in the above-mentioned manner, the laundry undergoes a twisting or pressing action. This twisting or pressing action is repeatedly imparted to the laundry through the reverse rotation of the vessel-shaped stirring member 24.

Further, because the laundry is pushed toward the peripheral wall of the washing tub 16 due to the centrifugal force resulting from the rotation of the vessel-shaped stirring member 24, a counteraction, or centripetal force acts inwards from the upper peripheral wall of the tub 22. As a result, streams of water which vertically revolve in the mutually opposite directions as indicated by arrows Y are produced, causing the laundry to move in a complicated way.

As stated before, in this embodiment, the vessel-shaped stirring member 24 is formed like a taper gradually becoming larger in diameter from its lower portion to upper portion. For this reason in particular, the movement or motion of the laundry due to the centrifugal force becomes smooth. Besides, the water also comes to move smoothly. In this manner both the laundry and the water come to rise up more easily. Further, since, in the mentioned embodiment, the projection 40 is formed at the central part of the bottom of the vessel-shaped stirring member 24, the falling stream of water can be smoothly led toward the outer side from the central bottom part of the vessel-shaped stirring member 24, whereby the vertical revolution of the laundry (the movement of one item near the top to the bottom and vice versa) is promoted. Thus, the laundry undergoes the washing-by-rubbing action because of the great frictional contact between the items washed due to their complicated movements as well as to their frictional contact with the respective peripheral walls of the tub 22 and the vessel-shaped stirring member 24. At the same time, the laundry undergoes a kind of washing-by-massage action over its entire mass through the repetition of the twisting and pressing actions as well. The laundry is thus thoroughly washed by thus undergoing the above-mentioned actions.

Further, in this embodiment a plurality of first projections 30 are provided on the inner peripheral side surface of the vessel-shaped stirring member 24. For this reason, the laundry undergoes a stronger washing-by-rubbing action, as well as a stronger rotational force. Accordingly, the washing-by-rubbing action, and the washing-by-massage action imparted to the laundry in the tub 22, are also increased. Thus, it is possible to obtain a very good washing effect.

Further, in this embodiment, as previously stated the laundry is moved by its frictional contact with the respective peripheral walls of the tub 22 and the vessel-shaped stirring member 24. Accordingly, as the amount of laundry increases, the frictional force involved also increases in magnitude. Accordingly, it is impossible that the readiness with which the laundry is moved be impaired by an increase in the load. Accordingly, any reduction in the washing effect would remain small even when the amount of laundry is increased. In addition, where the laundry load is small, the frequency of its contacting the peripheral wall of the vessel-shaped stirring member 24 becomes low and, at the same time, the frictional force resulting from such a contact also becomes small. Accordingly, the laundry is allowed to flow and to be washed by the stream of water caused to cycle in the whole interior of the washing tub due mainly to the low-speed rotation of the stirring member 24 having a large inner surface area. Since, therefore, the stream of water does not become excessively strong as compared with the stream of water created by the above-mentioned prior art washing machine of a pulsator type, even when the load of laundry is small, neither an excessive washing nor an insufficient washing takes place.

Further, in this embodiment, the second projection 32 having a height greater than the height of the above-mentioned first projection 30 is provided on the inner bottom surface of the vessel-shaped stirring member 24. For this reason, a relatively strong and yet effective washing water stream is created so as to enable the washings to flow moderately, whereby it becomes possible to obtain a necessary degree of washing operation. That is to say, the laundry can be thus washed with a moderate degree of success regardless of the size of the load. These matters indicate that the range in the size of laundry loads within which cleaning can be effectively done is wider than that possible with the above-mentioned prior art washing machine.

Further, by providing the first projections 30, the inner surface of the vessel-shaped stirring member 24 can be made irregular. Therefore, the laundry is more frequently caught or engaged against the circumference of the inner surface of the peripheral wall of the stirring member 24. In this way, it becomes possible to obtain a strong washing-by-massage action and, at the same time, it becomes also possible to intensify the washing-by-rubbing action. Secondly, the laundry is more likely to circulate upwards from the inner peripheral wall surface of the stirring member 24. Further, the concave portions (the space between two adjacent first projections 30) are prevented from being blocked by the laundry itself and, in addition, serve to conduct the water caused to flow by centrifugal force, thus imparting an upwardly pushing force to the laundry. Accordingly, the laundry is more likely to more upwards from the inner peripheral wall surface.

Further, owing to the existence of the protruded portion 40, a downward stream of water is smoothly guided from the central part toward the peripheral wall of the vessel-shaped stirring member 24, and upper portions and lower portions of the laundry can more frequently change places with each other. Thus, it is possible finally to obtain a stronger and more uniform washing effect.

Figure 4:
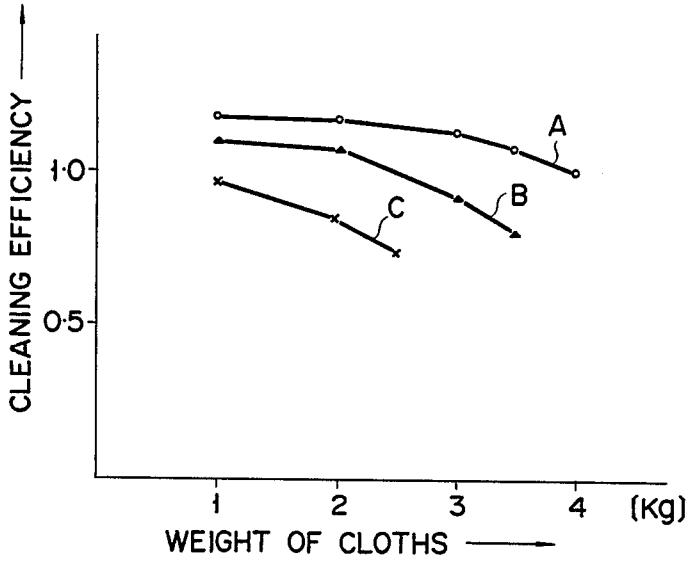
FIG. 4 is a diagram showing, as compared with the prior art, the relationship between the cleaning efficiency and the weight of the dirty laundry.

The fact that the washing or cleaning effect of the washing machine with a dehydrating function according to the present invention is excellent will be apparent from the graphic diagram shown in FIG. 4 as one example of the results of comparison. In FIG. 4, a curve A indicates the cleaning efficiency which is attained by the embodiment of the present invention. A curve B indicates the cleaning efficiency attained by a prior art washing machine of a pulsator type, and a curve C indicates the cleaning efficiency attained by a washing machine using only washing-tub rotation which was conceived prior to the present invention. It will be seen that the cleaning effect according to the embodiment of the present invention is high. Note here that said cleaning efficiency is regulated by JIS (Japanese Industrial Standard) C 9606.

The dehydrating operation according to this embodiment is performed by draining or discharging the water in the tub through the releasing of the drainage valve 56, and actuating the clutch mechanism (not shown), etc., thereby unidirectionally rotating the tub 22 integrally with the vessel-shaped stirring member 24.

The structural effect of the washing machine of the embodiment will now be described. The protruded portion 40 is provided on the central part of the bottom of the vessel-shaped stirring member 24, whereby it is possible to deepen the depth D (see FIG. 1) of the first recessed portion 42 formed in the lower end of the protruded portion 40. For this reason, the depth over which the washing shaft 28 is fitted with the first recessed portion 42 can be made greater than in the prior art. Thus, the attachment strength with which the vessel-shaped stirring member 24 is attached is increased with the result that it becomes possible to make the roll of the vessel-shaped stirring member 24 small during the operation thereof. Accordingly, it is possible to make the distance E (see FIG. 1) between the inner surface of the bottom of the water-receiving tub 12 and the undersurface of the tub 22 smaller. Also, it is possible to make the gap F (see FIG. 1) between the inner periphery of the tub 22 and the outer upper-end periphery of the vessel-shaped stirring member 24 smaller. Thus, it becomes possible to increase the size of the load without enlarging the outer dimension of the outer casing 10.

The present invention is not limited to the above-mentioned embodiment, but permits various modifications to be made without departing from the spirit and scope of the invention. Hereinafter, various modifications will be described.

Figure 5:
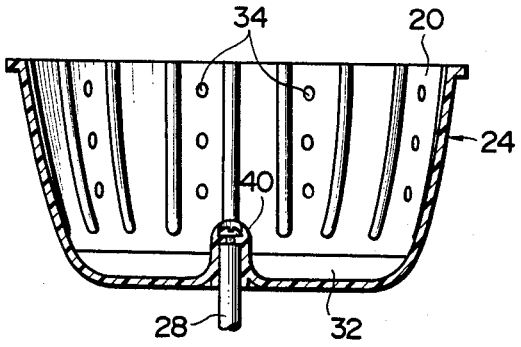
FIG. 5 is a vertical sectional view showing a lower peripheral wall section according to a first modification of one embodiment.

For example, although the above-mentioned embodiment has been described in the form that the invention is applied to a washing machine having a dehydrating function, the invention is not limited to such an embodiment, but may be applied to a washing machine having no dehydrating function. Accordingly, it is possible to construct the invention in the form of having the water-receiving tub omitted, by eliminating from the peripheral wall of the tub the aperture, and by storing water in said water-receiving tub per se. Further, the lower peripheral wall section 20 is not limited to the above-mentioned tapered structure. It can also be made into a structure having a greater diameter from lower portion toward the upper portion by degrees. For example, it may be formed into a bowl having a gently curved surface, as shown in FIG. 5 as a first modification. In this case, only the inner surface of the lower peripheral wall section may be made into a structure having a gradually greater diameter from its lower to its upper portion.

Figure 6:
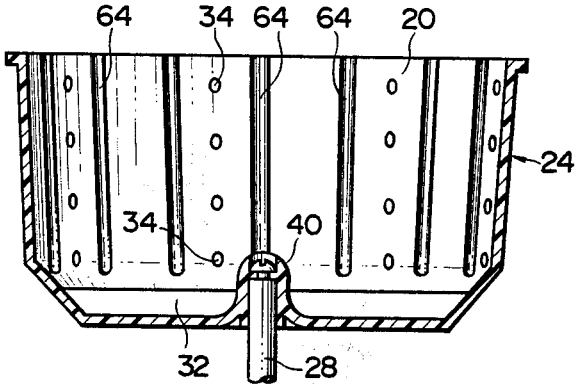
FIG. 6 is a vertical sectional view showing a lower peripheral wall section according to a second modification of one embodiment.
Figure 7:
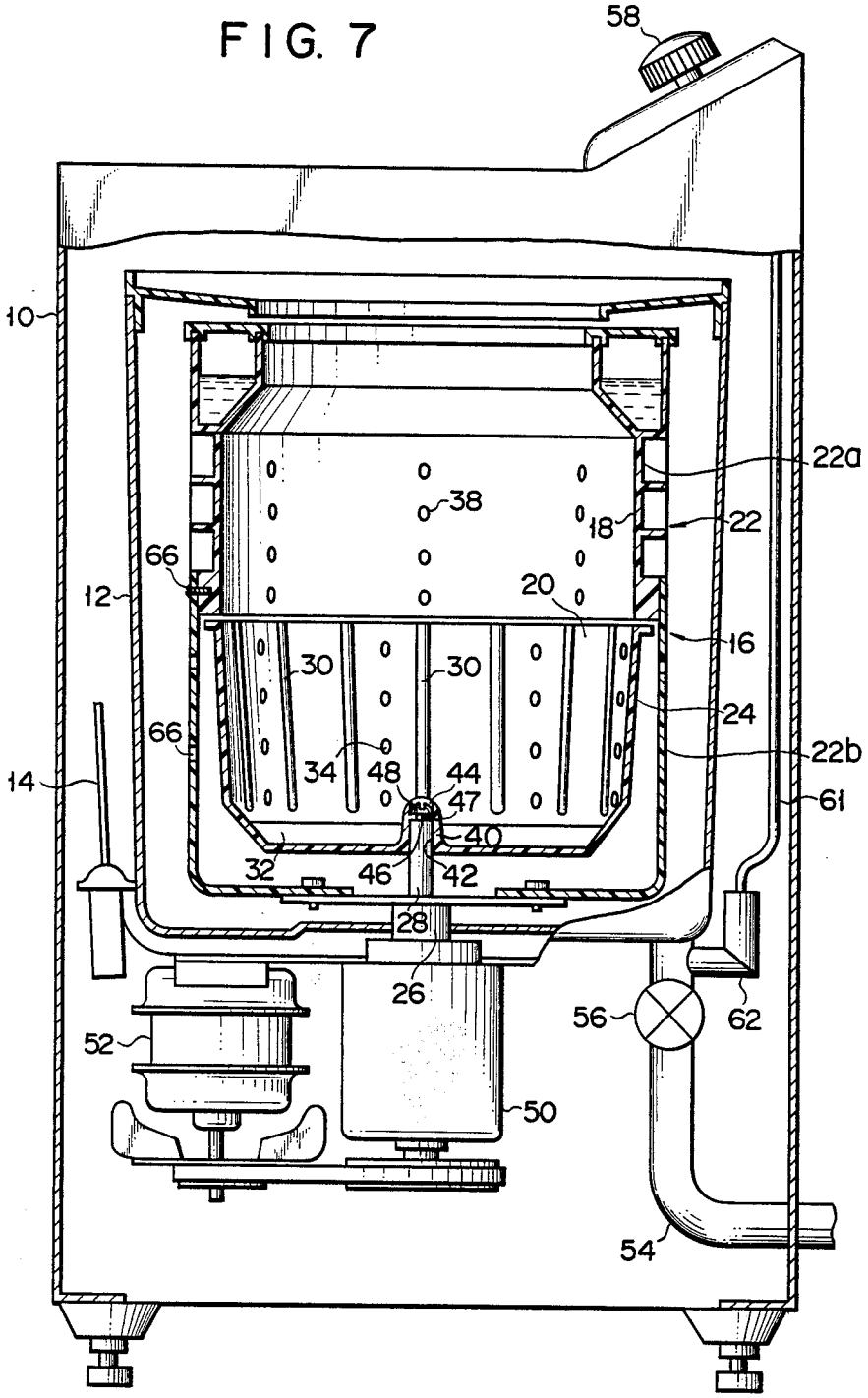
FIG. 7 is a vertical sectional view showing a stationary tub according to a third modification of one embodiment.

Further, in the above-mentioned embodiment, the first projections 30 were used to make the lower peripheral wall section 20 into a structure having an irregular surface. However, it may be made into such an irregular surface structure by providing a large number of vertically extending grooves 64 as shown in FIG. 6 as a second modification.

Further, in the above-mentioned embodiment, an explanation was made showing that the tub 22 is formed as an integral unit. However, the tub 22 may be constructed such that it has an upper tub section **22*a* having only the upper peripheral wall section 18, and a lower tub section 22*b* provided opposite to the lower peripheral wall section 20, both said upper and lower tub sections 22*a*, 22*b* being integrally coupled together by means of screws 66. By constructing the tub 22 in such manner, it is possible to make the lower end of the upper peripheral wall section 18 flush with the upper end edge of the lower peripheral wall section 20**, whereby the vertical revolution of the laundry can be effected more smoothly.

Figure 8:
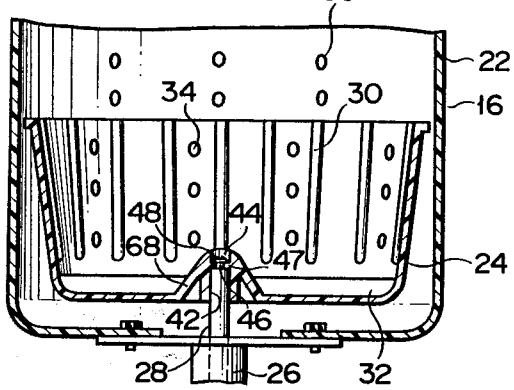
FIG. 8 is a vertical sectional view showing a protruded portion according to a fourth modification of one embodiment.

Further, in the above-mentioned embodiment, an explanation was made such that the protruded portion 40 is made columnar. However, as shown in FIG. 8 as a fourth modification, a protruded portion 68 is made into a conical shape whose outer surface is gently and outwardly inclined. This conical protruded portion 68 effectively performs its function to smoothly guide, as if it diffuses, a falling water stream of the vertically revolving water streams at the time of the washing operation, from the central bottom portion toward the periphery of the vessel-shaped stirring member 24. In this way, in this fourth modification, a vertical revolution (an interchange of upper portions with lower portions, or vice versa) of the laundry is promoted to a higher degree, whereby the washing effect is greatly increased. At the same time, to say from a structural point of view, the attachment strength with which the vessel-shaped stirring member 24 is attached is further increased as mentioned bafore. At the same time, the size of the wash load can be enlarged without enlarging the outer dimension of the outer casing 10. As seen in these instances, the fourth modification makes it possible to obtain excellent effects as in the above-mentioned embodiment.

Figure 10:
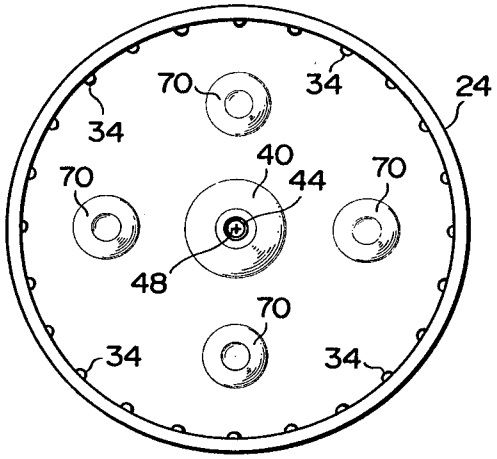
FIGS. 9 and 10 are vertical sectional and plan views showing a second projection according to a fifth modification of one embodiment.
Figure 9:
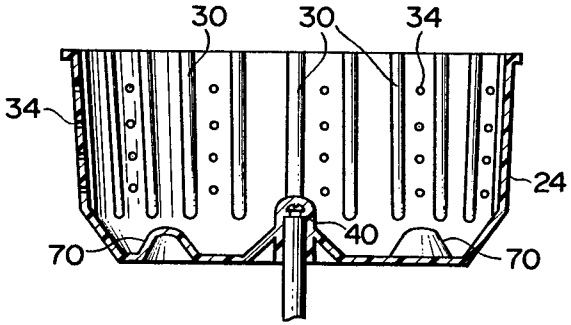

Further, in the above-mentioned embodiment, an explanation was made such that second projections 32 consist of a plurality of linear projections. However, the invention can also include lump-shaped projections instead of the linear projections shown in FIGS. 9 and 10 as a fifth modification. In this case as well, it is possible to obtain the same action and effect as mentioned in connection with the embodiment.

Figure 11:
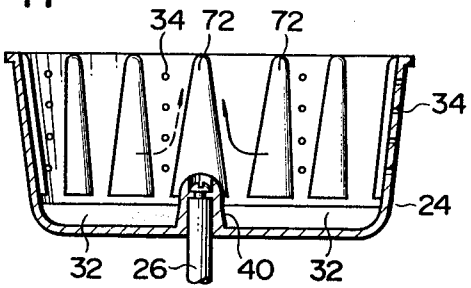
FIG. 11 is a vertical sectional view showing a first projection according to a sixth modification of one embodiment.
Figure 13:
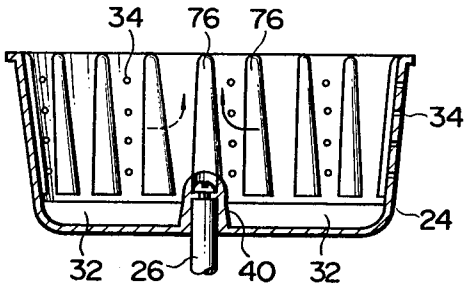
FIG. 13 is a vertical sectional view showing the first projection according to an eighth modification of one embodiment; and, FIG. 14 is a plan view showing a second projection according to a ninth modification of one embodiment.

Further, in the above-mentioned embodiment, an explanation was made such that, in the case of using the first projections 30 consisting of the vertically extending linear projections, the circulation of the water and laundry is smoothly effected, thereby obtaining the effect of promoting the interchanging of the upper portion of the load with lower portions. However, the first projections may be substituted by projections 72 which are wide in their lower portions and narrow in their upper portions as shown in FIG. 11 as a sixth modification. By substituting such projections 72, when the vessel-shaped stirring member 24 is allowed to rotate clockwise and counterclockwise, a much stronger raising force can be imparted to the water and the laundry because of the inclined surfaces of the projections 72 at both sides thereof, as indicated in FIG. 11 by the arrows. Thus, the interchanging of upper portions with the lower portions of the water along with the laundry can be further promoted.

Figure 12:
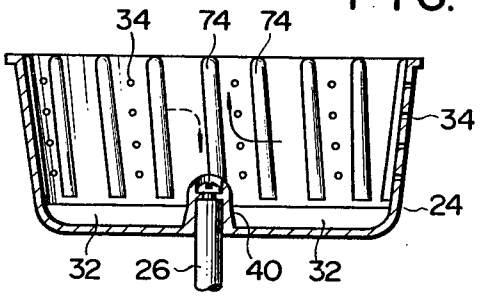
FIG. 12 is a vertical sectional view showing the first projection according to a seventh modification of one embodiment.

Further, the first projections 30 may be also substituted by projections 74 which are provided on the entire inner surface of the upper peripheral wall section 20 in such a manner that they are inclined in the direction of the normal rotation (as illustrated in the counterclockwise direction) of the vessel-shaped stirring member 24, as shown in FIG. 12 as a seventh modification.

By constructing the projections 74 as such, it is possible to impart peculiar changes to the respective movements of the water and the laundry, in such a manner that when the vessel-shaped stirring member 24 is allowed to rotate normally, the projections 74 act to lower the water and the laundry as indicated by the arrow. When the member 24 is allowed to rotate in reverse, the projections 24 act to raise the water and the laundry as indicated by the arrow.

Further, the present invention may be also reduced to practice by using, in place of the first projections 30, projections 76 each having one side which is perpendicular to the inner peripheral-wall surface of the vessel-shaped stirring member 24, the other side being inclined with respect to the surface of the inner peripheral-wall.

By constructing the projections 76 as such, it is possible to diversify the magnitude of the raising force in such a manner as to impart an ordinary raising force to the water and laundry when the vessel-shaped stirring member 24 is rotating normally and impart a greater raising force thereto at the time of reverse rotation of the stirring member 24.

Figure 14:
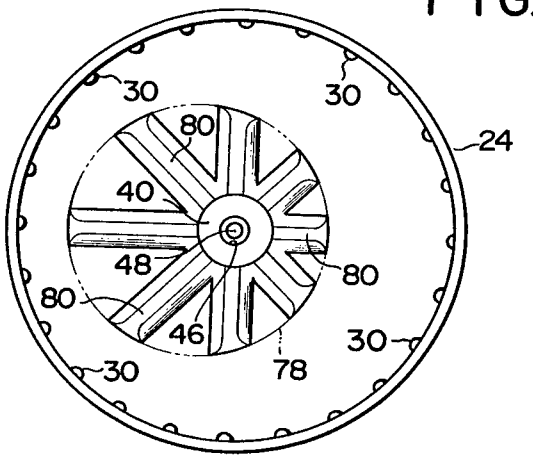

As shown in FIG. 14 as a ninth modification, it is possible, in place of the second projection 32, to provide second projections 80 having different lengths which radially extend from a central bottom portion of the vessel-shaped stirring member 24 and whose tip ends are located on the outer circumference of a circle 78 whose center is somewhat displaced from the center of the vessel-shaped stirring member 24. By providing such second projections 80, it is possible to make the washing water flow in a more complicated manner than has been mentioned before and, at the same time, to promote the interchange between the upper and lower portions of a small amount of laundry.

What is claimed is:

1. A washing machine comprising:

an outer casing open at a top end thereof;

a cylindrical washing tub coaxially disposed in said outer casing and rotatable about a fixed vertical axis, said washing tube formed with (1) a constant diameter upper peripheral wall section located at an upper region thereof, and (2) a stirring member, provided beneath said upper peripheral wall section and separately rotatable therefrom, with the only portion of said washing tub that is above a top-most end of said stirring member being said constant diameter upper section, said stirring member extending substantially halfway up the height of said washing tub, and having an inner peripheral surface formed such that its diameter gradually linearly increases from its lower portion toward its upper portion; and means for rotating: (a) said stirring member and said tub together during a dehydration operation, and (b) said stirring member alternately in opposite directions during a washing operation while holding said tube stationary, said stirring member thereby rotating a bottom-most portion of said washing machine, while said upper peripheral wall remains stationary, which washes laundry due to the friction between the laundry and the rotating stirring member, and between the rotating laundry and the stationary upper peripheral wall, the varying diameter of said stirring member causing vertical motion of said laundry and increasing the washing effect.

2. The washing machine according to claim 1, wherein said upper peripheral wall section has a lower edge having a diameter substantially equal to the diameter of an upper edge of said stirring member.

3. The washing machine according to claim 1. wherein said washing tub has a first bottomed tub received in said outer casing and a second bottomed tub received at a lower part of the interior of said first bottomed tub, said upper peripheral wall section being constituted by a peripheral wall portion of said first bottomed tub located above said second bottomed tub, said stirring member being constituted by a peripheral wall of said second bottomed tub.

4. The washing machine according to claim 3, wherein said first bottomed tub is integrally formed from said upper peripheral wall section and a portion thereof in which is received said stirring member.

5. The washing machine according to claim 3, wherein said first bottomed tub has the upper peripheral wall portion, a third bottomed portion thereof in which is received the stirring member, and a securing means for securing said first and third portions to each other.

6. The washing machine according to claim 3, wherein said second bottomed tub has a height equal to approximately one half of the height of said first bottomed tub.

7. The washing machine according to claim 6, wherein said stirring member has an inner peripheral surface which is made irregular.

8. The washing machine according to claim 6, wherein said second bottomed tub has at its central bottom portion a third cylindrical projection which is vertically extended.

9. The washing machine according to claim 8, which further comprises a washing shaft which causes said second bottomed tub to rotate clockwise and counterclockwise, an upper end portion of said washing shaft being extended through the underside of said first bottomed tub and secured to said third projection of said second bottomed tub.

10. The washing machine according to claim 9, wherein said first bottomed tub is made rotatable and is provided, at its peripheral wall, with a large number of through apertures, and which further comprises a water receiving tub which receives said first bottomed tub therein and is provided such that it is made motionless; and a dehydrating shaft which is provided coaxially with said washing shaft and is extended through the bottom of said water-receiving tub and is fixed to said first bottomed tub, whereby, during the washing operation, said dehydrating shaft serves to make said first bottomed tub motionless, and, during the dehydrating operation, serves to drive said first bottomed tub to rotate jointly with said second bottomed tub.

11. The washing machine according to claim 8, wherein said third projection has an outer peripheral surface which is substantially made upright.

12. The washing machine according to claim 1, wherein said stirring member has an inner peripheral wall surface which is made irregular by being provided with a plurality of first vertically extending projections.

13. The washing machine according to claim 12, wherein each portion between adjacent projections is provided with at least one through hole.

14. The washing machine according to claim 12, wherein said second bottomed tub has on its inner bottom surface a plurality of second projections radially extending from a central part toward a periphery of the second bottomed tub.

15. The washing machine according to claim 14, wherein said second projections have a height greater than that of said first projections.

16. A washing machine comprising:

an outer casing having an opening in a top end thereof;

washing tub means for holding items of laundry, disposed in said outer casing so as to be rotatable about a vertical axis thereof and including:

(1) a washing tub, having an upper portion with a substantially constant inner diameter, and (2) a lower section, formed of a stirring member located in the bottom of said washing tub and independently coaxially rotatable with respect to said washing tub, said stirring member having an inner peripheral surface formed with a diameter that gradually increases from a lower portion thereof toward an upper portion, an upper end of said lower section being at a same level as a lower end of said an upper portion of said washing tub; and drive means for rotating said upper portion and lower sections of said washing tub simultaneously in one direction during dehydrating, and for rotating the lower section alternately in different rotating directions while stopping rotation of the upper position during washing.

17. The washing machine according to claim 16, wherein the increasing diameter of said inner peripheral surface of said lower section increases in a linear manner, so that said inner peripheral surface has the shape of a frustrum of a cone.

18. The washing machine according to claim 16, wherein said washing tub means has a first bottomed tube received in said outer casing and a second bottomed tub received at a lower part of the interior of said first bottomed tub, a wall section of said washing tub being constituted by a peripheral wall portion of said first bottomed tub located above said second bottomed tub, said lower section being constituted by a peripheral wall of said second bottomed tub.

* * * * *